US011207700B2

(12) United States Patent
Yang et al.

(10) Patent No.: US 11,207,700 B2
(45) **Date of Patent: *Dec. 28, 2021**

(54) ROTATING SPRAY DEVICE FOR LUBRICANT

(71) Applicant: CITIC Dicastal Co., Ltd., Qinhuangdao (CN)

(72) Inventors: Jinling Yang, Qinhuangdao (CN); Xiaoting Zhu, Qinhuangdao (CN); Jiansheng Wang, Qinhuangdao (CN); Weizhou Liu, Qinhuangdao (CN); Hongshen Zhang, Qinhuangdao (CN); Haibin Liu, Qinhuangdao (CN); Li Yang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 197 days.

This patent is subject to a terminal disclaimer.

(21) Appl. No.: 16/561,338

(22) Filed: Sep. 5, 2019

(65) Prior Publication Data

US 2020/0298259 A1 Sep. 24, 2020

(30) Foreign Application Priority Data

Mar. 21, 2019 (CN) ..... 201910216251.6

(51) Int. Cl.

| | |
|---|---|
| ***B05B 7/00*** | (2006.01) |
| ***B05B 7/08*** | (2006.01) |
| ***B05B 3/02*** | (2006.01) |

(52) U.S. Cl.
CPC ..... *B05B 7/0892* (2013.01); *B05B 3/02* (2013.01)

(58) Field of Classification Search
CPC ..... B05B 7/0892; B05B 3/02; B05B 7/045
See application file for complete search history.

(56) References Cited

U.S. PATENT DOCUMENTS

| | | | | |
|---|---|---|---|---|
| 2,800,366 A * | 7/1957 | Scruggs | B08B 9/0936 | 239/97 |
| 4,219,155 A * | 8/1980 | Goerss | A47L 11/03 | 239/124 |
| 4,443,271 A * | 4/1984 | Goerss | A47L 11/03 | 134/34 |
| 2002/0104899 A1 * | 8/2002 | Schultz | B05B 1/14 | 239/380 |

* cited by examiner

*Primary Examiner* — Qingzhang Zhou
(74) *Attorney, Agent, or Firm* — IPRO, PLLC

(57) ABSTRACT

Provided is a rotating spray device for a lubricant, wherein the rotating driving mechanism rotates to drive the rotating spindle, and the rotating spindle drives the upper and lower rotating spray trays to rotate, and compressed air and a lubricant are respectively fed into each pitch circle closed cavity formed between each of the rotating spray trays and the spray tray main body, and then are sprayed out through the nozzles on the rotating spray trays for uniform spray coating. The device can spray the same and uniform dosage of the lubricant to the working surfaces of the maximum pitch circles of upper and lower dies, play a role of uniform forging lubrication and reduce the forging defects.

10 Claims, 2 Drawing Sheets

ROTATING SPRAY DEVICE FOR LUBRICANT

FIELD

The present disclosure relates to the technical field of forging equipment, and more particularly relates to a rotating spray device for a lubricant.

BACKGROUND

A wheel forging die of each process is divided into upper and lower dies. During use, it is necessary to spray a lubricant onto the working surfaces of the upper and lower dies to forge a good product. Therefore, whether it is manual production or automated production, each manufacturer sprays the lubricant onto the working surface of the die in a manual way or a stationary way, and the lubricant often cannot reach some places on the working surface or is often sprayed non-uniformly, which results in forging production defects and reduction of the finished product ratio of products. Meanwhile, these spray modes or devices are low in automation degree, time-consuming, labor-consuming and low in efficiency and affect the production efficiency of the products. In order to solve the problems that the lubricant cannot reach every place on the working surface of the die and is sprayed non-uniformly, to meet efficient production requirements and to improve the labor productivity, a rotating spray device for a wheel forging die lubricant is specially designed to eliminate the forging production defects and improve the production efficiency of the products.

SUMMARY

The embodiment of the present disclosure provides a rotating spray device for a lubricant, which can solve the problems that a lubricant cannot reach every place on the working surface of a die and is sprayed non-uniformly and implement that the lubricant is uniformly sprayed to the working surfaces of the maximum pitch circles of upper and lower dies, can control the same and uniform dosage of the lubricant to be sprayed to the working surfaces of the maximum pitch circles of the upper and lower dies, play a role of uniform forging lubrication and reduce forging defects, and can realize automatic spraying of the lubricant to the working surfaces of the maximum pitch circles of the upper and lower dies, increase the automation degree of equipment, meet efficient production requirements and improve the working efficiency.

In order to achieve the above disclosure objective, the present disclosure provides the following technical solution:

A rotating spray device for a lubricant is provided, comprising a spray tray main body, a spray tray connection body, rotating spray trays, nozzles, upper main connection pipes, upper air pipe joints, upper lubricant pipe joints, lower main connection pipes, lower air pipe joints, lower lubricant pipe joints, a rotating spindle, a transmission mechanism and a rotating driving mechanism, wherein, the spray tray connection body passes through the middle part of the spray tray main body and extends out of the spray tray main body; the spray tray main body is divided into an upper portion and a lower portion, and the sprat tray connection body is of a hollow cavity structure; each of the top surface and the bottom surface of the spray tray main body is provided with one rotating spray tray; the nozzles are mounted on the rotating spray trays; one or more circular-ring-shaped pitch circle closed cavities are formed between the rotating spray trays and the spray tray main body; each pitch circle closed cavity communicates with the outside through the nozzles; each pitch circle closed cavity formed between the rotating spray tray on the top surface and the spray tray main body is connected with one upper air pipe joint and one upper lubricant pipe joint through one upper main connection pipe; compressed air is input through the upper air pipe joints, and a lubricant is input through the upper lubricant pipe joints; each pitch circle closed cavity formed between the rotating spray tray on the bottom surface and the spray tray main body is connected with one lower air pipe joint and one lower lubricant pipe joint through one lower main connection pipe; the compressed air is input through the lower air pipe joints, and the lubricant is input through the lower lubricant pipe joints; the rotating spindle passes through the rotating spray tray on the top surface, the upper portion of the spray tray main body, the spray tray connection body, the lower portion of the spray tray main body and the rotating spray tray on the bottom surface from the center portions of the rotating spray trays from top to bottom; the rotating spray tray on the top surface and the rotating spray tray on the bottom surface are fixed on the rotating spindle, and may rotate with the rotation of the rotating spindle; the rotating driving mechanism is also arranged on the spray tray main body; an output shaft of the rotating driving mechanism passes through the upper portion of the spray tray main body, the spray tray connection body and the lower portion of the spray tray main body, or the rotating driving mechanism is arranged on the spray tray connection body, and the output shaft of the rotating driving mechanism passes through the spray tray connection body from top to bottom; the transmission mechanism is located in the hollow cavity structure of the spray tray connection body; the transmission mechanism is connected with the rotating driving mechanism and the rotating spindle; and the rotating driving mechanism rotates to drive the rotating spindle through the transmission mechanism to rotate; the rotating spindle drives the rotating spray tray located on the top surface and the rotating spray tray located on the bottom surface to rotate; the compressed air and the lubricant are respectively fed into each pitch circle closed cavity formed between each of the rotating spray trays and the spray tray main body, and then are mixed and sprayed out through the nozzles on the rotating spray trays for spray coating.

In some embodiments, wherein the rotating driving mechanism comprises a servo motor, a motor shaft flange, a coupling, belt rotating motor shaft bearings, a belt rotating motor shaft and an end flange; the servo motor is arranged on the motor shaft flange; the motor shaft flange is fixed on the upper end face of the spray tray main body or the upper end face of the spray tray connection body, and is used to fix the servo motor; the belt rotating motor shaft bearings are used to fix the belt rotating motor shaft; two belt rotating motor shaft bearings are respectively located at the upper and lower ends of the belt rotating motor shaft; the upper and lower belt rotating motor shaft bearings are fixed in the spray tray main body or the spray tray connection body; the end flange is arranged at the lower end of the belt rotating motor shaft, located on the lower end face of the spray tray main body or the lower end face of the spray tray connection body, and used to fix the belt rotating motor shaft bearings and the belt rotating motor shaft; an output shaft of the servo motor passes through the motor shaft flange and is connected to the coupling; the coupling is connected with the output shaft of the servo motor and the belt rotating motor shaft; the portion, located in the spray tray connection body, of the belt rotating motor shaft is provided with a first connection key;

and the first connection key is connected with the transmission mechanism. The rotating driving mechanism is provided with the upper and lower bearings and the upper and lower flanges. Meanwhile, the rotating shaft is arranged in a spray tray main body, so that the lubricant is avoided from being sprayed into the rotating driving mechanism, which makes the device firm in structure and stable in operation and improves the safety of system operation. Meanwhile, the device is simple in structure and facilitates low-cost manufacturing and use.

In some embodiments, wherein the transmission mechanism comprises a small belt wheel, a toothed belt and a large belt wheel; a second connection key is arranged on the rotating spindle; the small belt wheel is fixed on the belt rotating motor shaft through the first connection key; the large belt wheel is fixed on the rotating spindle through the second connection key; the toothed belt is connected with the small belt wheel and the large belt wheel; the belt rotating motor shaft rotates to drive the small belt wheel to rotate, and the small belt wheel drives the large belt wheel through the toothed belt to rotate, and the large belt wheel drives the rotating spindle to rotate the transmission mechanism is arranged in the hollow cavity of the spray tray connection body, so that the lubricant is avoided from being sprayed to the transmission mechanism, which makes the device stable in operation and improves the safety of system operation. Meanwhile, the device is simple in structure and facilitates low-cost manufacturing and use.

In some embodiments, wherein the output end of each upper main connection pipe has a horizontal 270-degree circular arc bend; one output port is arranged on the horizontal 270-degree circular arc bend every 90 degrees, and communicates with the upper circular-ring-shaped pitch circle closed cavity corresponding to the upper main connection pipe; the output end of each lower main connection pipe has a horizontal 270-degree circular arc bend; and one output port is arranged on the horizontal 270-degree circular arc bend every 90 degrees, and communicates with the lower circular-ring-shaped pitch circle closed cavity corresponding to the lower main connection pipe.

In some embodiments, wherein an upper bearing of spindle and a lower bearing of spindle are respectively arranged at the upper portion and the lower portion of the rotating spindle; the upper bearing of spindle is located in the rotating spray tray on the top surface, and is in contact with the upper surface of the spray tray main body; the lower bearing of spindle is located in the rotating spray tray on the bottom surface, and is in contact with the lower surface of the spray tray main body; an upper bearing of rotating spray tray is arranged between the rotating spray tray on the top surface and the spray tray main body; and a lower bearing of rotating spray tray is arranged between the rotating spray tray on the bottom surface and the spray tray main body. the design of the bearings among the rotating spindle, the rotating spray trays and the spray tray main body makes the friction of a rotating component lower and makes the rotation more stable.

In some embodiments, wherein four nozzles are arranged on the rotating spray tray on each pitch circle closed cavity, and are spaced by 90 degrees; the positions of the nozzles of the various pitch circle closed cavities at the upper end of the spray tray main body correspond to one another, and the nozzles in all the directions are located on one straight line; the positions of the nozzles of the various pitch circle closed cavities at the lower end of the spray tray main body correspond to one another, and the nozzles in all the directions are located on one straight line. The corresponding arrangement of the nozzles is more favorable for realizing spraying of the same and uniform dosage of the lubricant onto the working surface, so that the spray efficiency is improved, and the lubricant is sprayed uniformly.

In some embodiment, wherein sealing rings are arranged between the pitch circle closed cavities at the upper end of the spray tray main body and between the rotating spray tray on the top surface and the spray tray main body; and sealing rings are arranged between the pitch circle closed cavities at the lower end of the spray tray main body and between the rotating spray tray on the bottom surface and the spray tray main body. The arrangement of the sealing rings avoids leakage of lubricant liquid under the air pressure, thereby avoiding the influence on the spray quality and the use safety of the device.

In some embodiments, wherein the spray tray connection body and the spray tray main body are of an integrated structure, and the upper main connection pipes and the lower main connection pipes are passages arranged in the spray tray connection body and the spray tray main body.

In some embodiments, wherein the input ends of the upper main connection pipes and the lower main connection pipes are all provided with main pipe joints, and the main pipe joints are connected with the upper air pipe joints and the upper lubricant pipe joints or the main pipe joints are connected with the lower air pipe joints and the lower lubricant pipe joints; the output ports of the upper main connection pipes and the lower main connection pipes are all provided with internal nozzles; and the internal nozzles are located in the pitch circle closed cavities.

In some embodiments, wherein the upper air pipe joints and the lower air pipe joints are connected to a compressed air valve body control pipeline, and the upper lubricant pipe joints and the lower lubricant pipe joints are connected to a lubricant valve body control pipeline; the device further has a control unit; the control unit is connected with pipeline valve bodies of the compressed air valve body control pipeline and the lubricant valve body control pipeline and the servo motor in the rotating driving mechanism in a signal manner; the control unit controls the flow rates, the flow velocities and the pressures of the compressed air and the lubricant by controlling the pipeline valve bodies, and controls the rotating speed and rotating time by controlling the servo motor, thereby controlling the amount of the lubricant sprayed to the surface of a die. In this way, the flow rates, the flow velocities and the pressures of the compressed air and the lubricant which flow into the upper main connection pipes and the lower main connection pipes are controlled by controlling the pipeline valve bodies, so as to spray the compressed air and lubricant mixture into the various closed cavities and then to the working surface through the nozzles, and the dosage of the lubricant on the working surface of the die is automatically controlled by controlling the rotating speed and rotating time of the servo motor, thereby achieving the forging lubrication objective and reducing the forging defects.

Compared with the prior art, the present disclosure has the beneficial effects that: the present disclosure provides the rotating spray device for a lubricant. The rotating driving mechanism drives the rotating spindle through the transmission mechanism to rotate, and the rotating spindle drives the upper and lower rotating spray trays to rotate. The compressed air and the lubricant are respectively fed into each pitch circle closed cavity formed between each of the rotating spray trays and the spray tray main body, and then are sprayed out through the nozzles on the rotating spray trays for spray coating. The device can spray the same and uniform dosage of the lubricant to the working surfaces of the maximum pitch circles of the upper and lower dies, play a role of uniform forging lubrication and reduce the forging defects, and can realize automatic spraying of the lubricant to the working surfaces of the maximum pitch circles of the upper and lower dies, increase the automation degree of equipment, meet efficient production requirements, work safely and reliably and improve the working efficiency.

BRIEF DESCRIPTION OF THE DRAWINGS

In order to more clearly explain the technical solution in the embodiments of the application, drawings which require to be used in description of the embodiments are simply introduced below, obviously, the drawings in description below are some embodiments of the application, and those having ordinary skill in the art can further acquire other drawings without creative efforts according to those drawings.

Figure 1:
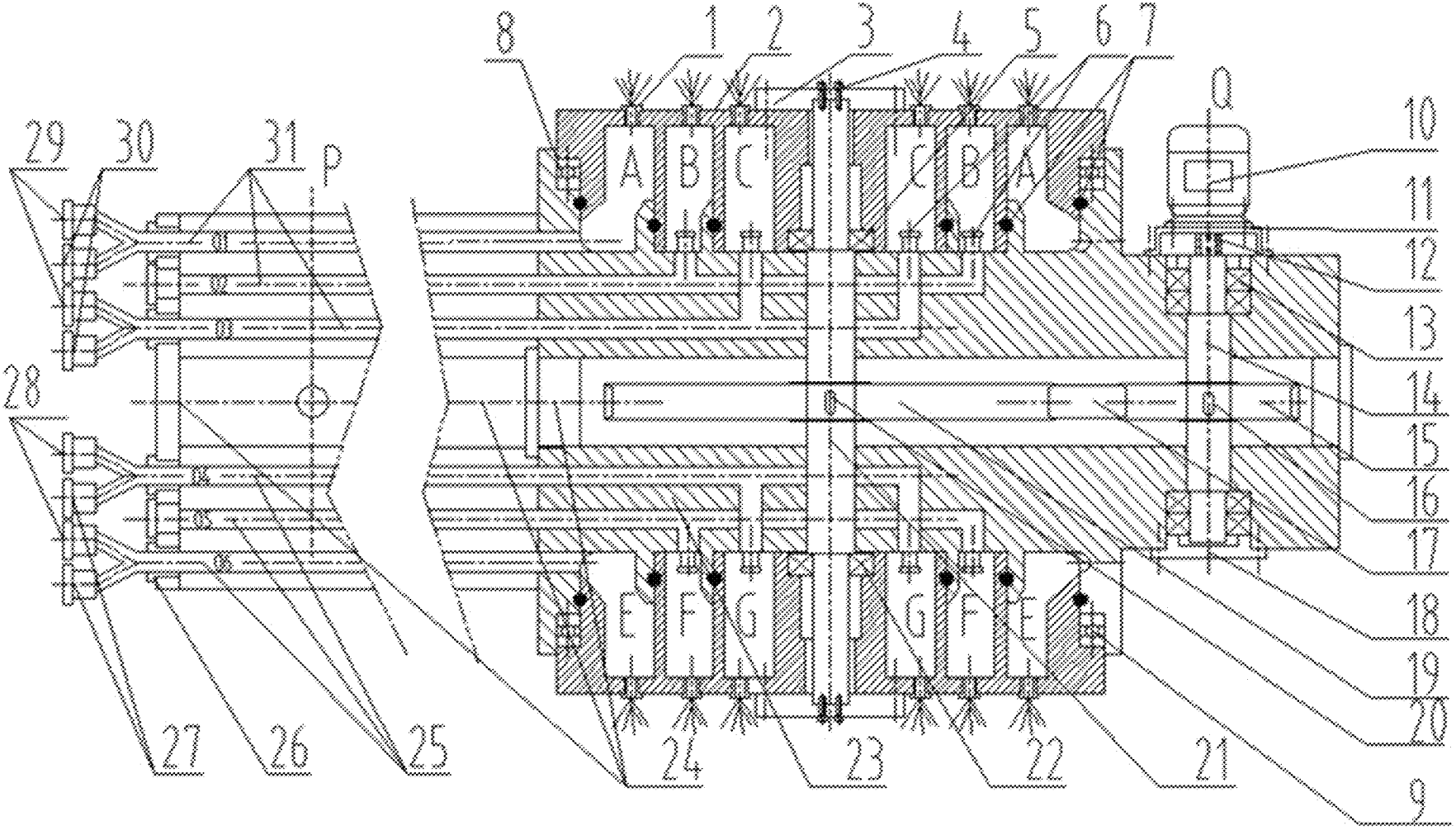
FIG. 1 is a structural schematic diagram of a rotating spray device for a lubricant of the present disclosure.

In the drawings: 1: nozzle; 2: rotating spray tray; 3: spindle flange; 4: connection screw; 5: upper bearing of spindle; 6: internal nozzle; 7: sealing ring; 8: upper bearing of rotating spray tray; 9: lower bearing of rotating spray tray; 10: servo motor; 11: motor shaft flange; 12: coupling; 13: belt rotating motor shaft bearing; 14: belt rotating motor shaft; 15: small belt wheel; 16: first connection key; 17: toothed belt; 18: end flange; 19: large belt wheel; 20: second connection key; 21: rotating spindle; 22: lower bearing of spindle; 23: spray tray main body; 24: spray tray connection body; 25: lower main connection pipe; 26: main pipe joint; 27: lower air pipe joint; 28: lower lubricant pipe joint; 29: upper air pipe joint; 30: upper lubricant pipe joint; and 31: upper main connection pipe.

DETAILED DESCRIPTION OF THE EMBODIMENTS

The technical solution in the embodiments of the application is clearly and completely described in combination with drawings of the embodiments of the application below, and obviously, the described embodiments are part of embodiments of the application rather than all embodiments. Based on the embodiments of the application, all the other embodiments obtained by those having ordinary skill in the art without any creative works are within the protection scope of the application.

The terms 'first', 'second', 'third', 'fourth' and the like in the specification and in the claims of the application are used for distinguishing different objects but not for describing a specific sequence. Furthermore, the terms 'comprise' and 'have' as well as their any variations are intended to cover a non-exclusive inclusion. For example, a process, method, system, product or equipment comprising a series of steps or units does not limit steps or units which have been listed, but selectively further comprises steps or units which are not listed, or selectively further comprises other inherent steps or units for the process, method, product or equipment.

Reference in the specification to 'embodiments' of the application means that a particular feature, structure or characteristic described in connection with the embodiments is included in at least one embodiment of the application. The appearances of the phrase 'the embodiments' in various places in the specification are not necessarily all referring to the same embodiment, nor are separate or alternative embodiments necessarily mutually exclusive of other embodiments. It will be explicitly and implicitly understood by those skilled in the art that the embodiments described in the application can be combined to other embodiments.

In order to further understand the content, features and functions of the disclosure, the following embodiments are given and illustrated with the attached drawings as follows:

Embodiment 1

Figure 2:
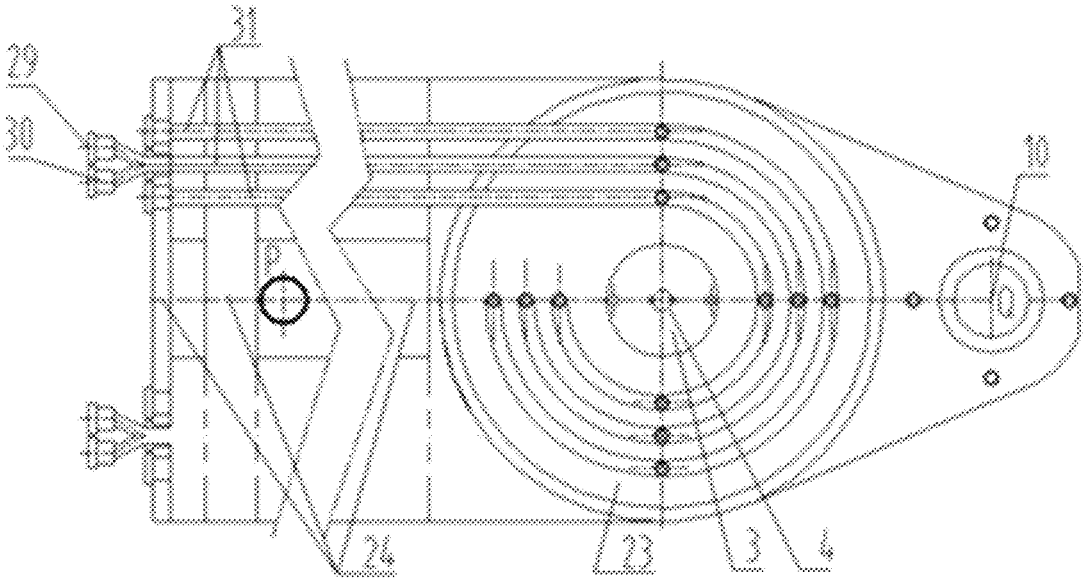
FIG. 2 is a top view of an upper line of a rotating spray device for a lubricant of the present disclosure.
Figure 3:
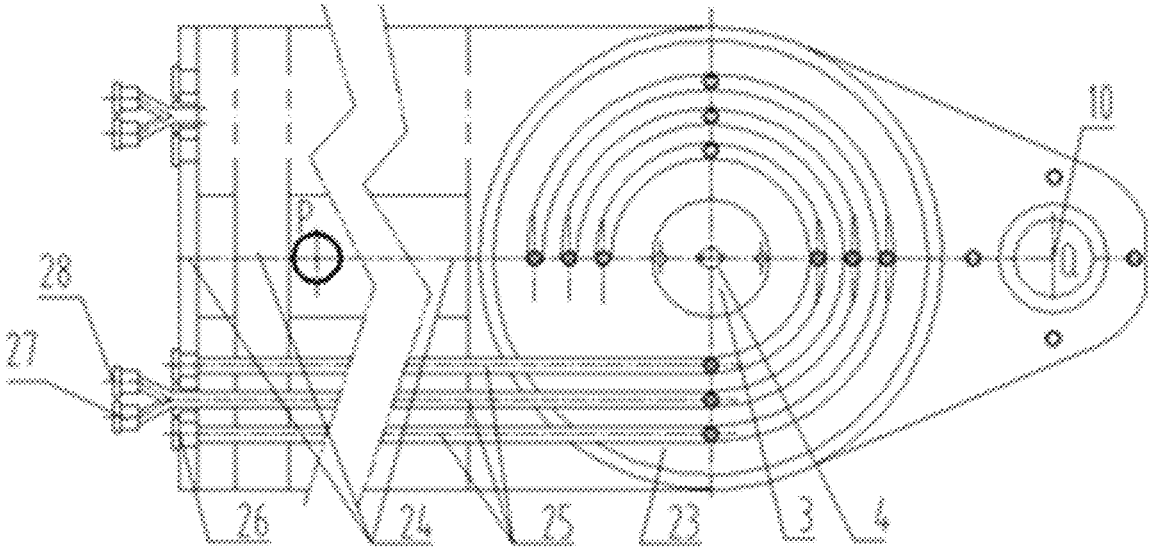
FIG. 3 is a top view of a lower line of a rotating spray device for a lubricant of the present disclosure.

Embodiment of the present disclosure is described below in combination with FIGS. 1 to 3. A disk-shaped rotating spray tray device for a wheel forging die lubricant includes a spray tray main body 23, a spray tray connection body 24, rotating spray trays 2, nozzles 1, upper main connection pipes 31, upper air pipe joints 29, upper lubricant pipe joints 30, lower main connection pipes 25, lower air pipe joints 27, lower lubricant pipe joints 28, a rotating spindle 21, a transmission mechanism, a rotating driving mechanism, spindle flanges 3, connection screws 4, sealing rings 7, main pipe joints 26, an upper bearing of spindle 5, a lower bearing of spindle 22, an upper bearing of rotating spray tray 8, a lower bearing of rotating spray tray 9 and internal nozzles 6. The spray tray connection body 24 passes through the middle part of the spray tray main body 23 and extends out of the spray tray main body 23. The spray tray main body 23 is divided into an upper portion and a lower portion, and the sprat tray connection body 24 is of a hollow cavity structure. Each of the top surface and the bottom surface of the spray tray main body 23 is provided with one rotating spray tray 2. The nozzles 1 are mounted on the rotating spray trays. One or more circular-ring-shaped pitch circle closed cavities are formed between the rotating spray trays 2 and the spray tray main body 23. As shown in FIG. 1, three circular-ring-shaped pitch circle closed cavities are formed between the rotating spray tray 2 on the top surface and the spray tray main body 23, and three circular-ring-shaped pitch circle closed cavities are also formed between the rotating spray tray 2 on the bottom surface and the spray tray main body 23. Each pitch circle closed cavity communicates with the outside through the nozzles 1. As shown in FIGS. 2 to 3, four nozzles 1 are arranged on the rotating spray tray 2 on each pitch circle closed cavity, and are spaced by 90 degrees. The positions of the nozzles 1 of the various pitch circle closed cavities at the upper end of the spray tray main body 23 correspond to one another, and the nozzles 1 in all the directions are located on one straight line. The positions of the nozzles 1 of the various pitch circle closed cavities at the lower end of the spray tray main body 23 correspond to one another, and the nozzles 1 in all the directions are located on one straight line. The sealing rings 7 are arranged between the pitch circle closed cavities at the upper end of the spray tray main body 23 and between the rotating spray tray 2 on the top surface and the spray tray main body 23. The sealing rings 7 are arranged between the pitch circle closed cavities at the lower end of the spray tray main body 23 and between the rotating spray tray 2 on the bottom surface and the spray tray main body 23. As shown in FIG. 1, the sealing rings 7 are arranged between the pitch circle closed cavities A and B as well as B and C and between the rotating spray tray 2 on the top surface and the spray tray main body 23; and the sealing rings 7 are arranged between the pitch circle closed cavities G and F as well as F and E and between the rotating spray tray 2 on the bottom surface and the spray tray main body 23. Each pitch circle closed cavity formed between the rotating spray tray 2 on the top surface and the spray tray main body 23 is connected with one upper air pipe joint 29 and one upper lubricant pipe joint 30 through one upper main connection pipe 31. As shown in FIG. 1, three pitch circle closed cavities are formed and have three upper main connection pipes 31 respectively marked as 01, 02 and 03. The input ends of the upper main connection pipes 31 are all provided with the main pipe joints 26, and the main pipe joints 26 are arranged at the end portion of the spray tray connection body 24 and are connected with the upper air pipe joints 29 and the upper lubricant pipe joints 30. The output end of each upper main connection pipe 31 has a horizontal 270-degree circular arc bend. One output port is arranged on the horizontal 270-degree circular arc bend every 90 degrees, and communicates with the upper circular-ring-shaped pitch circle closed cavity corresponding to the upper main connection pipe. The output ports of the upper main connection pipes 31 are connected with the internal nozzles 6. The internal nozzles 6 are located in the pitch circle closed cavities. The upper air pipe joints 29 and the upper lubricant pipe joints 30 are respectively connected to a compressed air pipe and a lubricant pressure tank of a workshop. Compressed air is input through the upper air pipe joints 29, and a lubricant is input through the upper lubricant pipe joints 30. Each pitch circle closed cavity formed between the rotating spray tray 2 on the bottom surface and the spray tray main body 23 is connected with one lower air pipe joint 27 and one lower lubricant pipe joint 28 through one lower main connection pipe 25. As shown in FIG. 1, three pitch circle closed cavities are formed and have three lower main connection pipes 25 respectively marked as 04, 05 and 06. The input ends of the lower main connection pipes 25 are all provided with the main pipe joints 26, and the main pipe joints 26 are arranged at the end portion of the spray tray connection body 24 and are connected with the lower air pipe joints 27 and the lower lubricant pipe joints 28. The output end of each lower main connection pipe 25 has a horizontal 270-degree circular arc bend. One output port is arranged on the horizontal 270-degree circular arc bend every 90 degrees, and communicates with the lower circular-ring-shaped pitch circle closed cavity corresponding to the lower main connection pipe. The output ports of the lower main connection pipes 25 are connected with the internal nozzles 6. The internal nozzles 6 are located in the pitch circle closed cavities. The lower air pipe joints 27 and the lower lubricant pipe joints 28 are respectively connected to the compressed air pipe and the lubricant pressure tank of the workshop. The compressed air is input through the lower air pipe joints 27, and the lubricant is input through the lower lubricant pipe joints 28. In the present embodiment 1, the spray tray connection body 24 and the spray tray main body 23 are of an integrated structure. The upper main connection pipes 31 and the lower main connection pipes 25 are passages arranged in the spray tray connection body 24 and the spray tray main body 23.

The rotating spindle 21 passes through the rotating spray tray 2 on the top surface, the upper portion of the spray tray main body 23, the spray tray connection body 24, the lower portion of the spray tray main body 23 and the rotating spray tray 2 on the bottom surface from the center portions of the rotating spray trays 2 from top to bottom. The rotating spray tray 2 on the top surface and the rotating spray tray 2 on the bottom surface are fixed on the rotating spindle 21, and may rotate with the rotation of the rotating spindle 21. Specifically, in the present embodiment, one spindle flange 3 is fixed at each of the upper and lower ends of the rotating spindle 21. The spindle flange 3 at the upper end is fixed at the upper end of the rotating spindle 21 through two connection screws 4, and the spindle flange 3 at the lower end is also fixed at the lower end of the rotating spindle 21 through two connection screws 4. The upper and lower spindle flanges 3 are respectively fixed on the upper and lower rotating spray trays 2. The upper bearing of spindle 5 and the lower bearing of spindle 22 are respectively arranged on the upper portion and the lower portion of the rotating spindle 21. The upper bearing of spindle 5 is located in the rotating spray tray 2 on the top surface, and is in contact with the upper surface of the spray tray main body 23. The lower bearing of spindle 22 is located in the rotating spray tray 2 on the bottom surface, and is in contact with the lower surface of the spray tray main body 23. The upper bearing of rotating spray tray 8 is arranged between the rotating spray tray 2 on the top surface and the spray tray main body 23, and the lower bearing of rotating spray tray 9 is arranged between the rotating spray tray 2 on the bottom surface and the spray tray main body 23. The rotating driving mechanism is also arranged on the spray tray main body 23. An output shaft of the rotating driving mechanism passes through the upper portion of the spray tray main body 23, the spray tray connection body 24 and the lower portion of the spray tray main body 23. The transmission mechanism is located in a hollow cavity structure of the spray tray connection body 24. The transmission mechanism is connected with the rotating driving mechanism and the rotating spindle 21. The rotating driving mechanism rotates to drive the rotating spindle 21 through the transmission mechanism to rotate. The rotating spindle 21 drives the rotating spray tray 2 located on the top surface and the rotating spray tray 2 located on the bottom surface to rotate. The compressed air and the lubricant are respectively fed into each pitch circle closed cavities formed between the rotating spray trays 2 and the spray tray main body 23, and then are mixed and sprayed out from the nozzles on the rotating spray trays for spray coating.

The rotating driving mechanism includes a servo motor 10, a motor shaft flange 11, a coupling 12, belt rotating motor shaft bearings 13, a belt rotating motor shaft 14 and an end flange 18. The servo motor 10 is arranged on the motor shaft flange 11. The motor shaft flange 11 is fixed on the upper end face of the spray tray main body 23, and is used to fix the servo motor. The belt rotating motor shaft bearings 13 are used to fix the belt rotating motor shaft 14. Two belt rotating motor shaft bearings 13 are respectively located at the upper and lower ends of the belt rotating motor shaft 14. The upper and lower belt rotating motor shaft bearings 13 are fixed in the spray tray main body 23. The end flange 18 is arranged at the lower end of the belt rotating motor shaft 14, located on the lower end face of the spray tray main body 23, and used to fix the belt rotating motor shaft bearings 13 and the belt rotating motor shaft 14. An output shaft of the servo motor 19 passes through the motor shaft flange 11 and is connected to the coupling 12. The coupling 12 is connected with the output shaft of the servo motor 10 and the belt rotating motor shaft 14. The portion, located in the spray tray connection body 24, of the belt rotating motor shaft 14 is provided with a first connection key 16. The first connection key 16 is connected with the transmission mechanism. The transmission mechanism includes a small belt wheel 15, a toothed belt 17 and a large belt wheel 19. A second connection key 20 is arranged on the rotating spindle 21. The small belt wheel 15 is fixed on the belt rotating motor shaft 14 through the first connection key 16. The large belt wheel 19 is fixed on the rotating spindle 21 through the second connection key 20. The toothed belt 17 is connected with the small belt wheel 15 and the large belt wheel 19. The belt rotating motor shaft 14 rotates to drive the small belt wheel 15 to rotate, and the small belt wheel 15 drives the large belt wheel 19 through the toothed belt 17 to rotate, and the large belt wheel 19 drives the rotating spindle 21 to rotate.

In actual use, firstly, the spray tray connection body 24 is connected to a peripheral telescopic control arm of equipment to realize extension and retraction of the device of the present disclosure at the middle position of a die, and then the upper air pipe joints 29, the upper lubricant pipe joints 30, the lower air pipe joints 27 and the lower lubricant pipe joints 28 are respectively connected to the compressed air pipe and the lubricant pressure tank of the workshop. Each group of upper air pipe joints 29 and upper lubricant pipe joints 30 are respectively connected to the upper connection pipes 31 01, 02 and 03, and respectively spray the compressed air and the lubricant into the three upper pipes 01, 02 and 03, and then the compressed air and lubricant mixture is sprayed into the closed cavities A, B and C and then to an upper die through the nozzles 1. Each group of lower air pipe joints 27 and lower lubricant pipe joints 28 are respectively connected to the lower main connection pipes 25 04, 05 and 06, and respectively spray the compressed air and the lubricant into the three lower pipes 04, 05 and 06, and then the compressed air and lubricant mixture is sprayed into the closed cavities E, F and G and then to a lower die through the nozzles 1. A spindle of the servo motor 10 drives the belt rotating motor shaft 14 to rotate, and the belt rotating motor shaft 14 rotates to drive the small belt wheel 15 to rotate together. The small belt wheel 15 drives the large belt wheel 19 through the toothed belt 17 to rotate, and the large belt wheel 19 and the connection key 20 are connected to drive the rotating spindle 21 to rotate together. The rotating spindle 21 drives the lower rotating spray tray 2 and the upper rotating spray tray 2 to rotate together. The compressed air and lubricant mixture is sprayed into the pitch circle closed cavities A, B and C and then sprayed to the upper die through the nozzles 1, and is also sprayed into the pitch circle closed cavities E, F and G and then sprayed to the lower die through the nozzles 1. The same dosage of the lubricant is sprayed onto the surfaces of the maximum pitch circles of the upper and lower dies, and the objective of uniformly spraying a forging lubricant onto the working surfaces of the upper and lower dies is achieved.

In addition, the air pipe joints and the lubricant pipe joints are connected to compressed air and lubricant valve body control pipelines. The flow rates, the flow velocities and the pressures of the compressed air and the lubricant which flow into the various pipes 01, 02 and 03 of the upper main connection pipes 31 and the various pipes 04, 05 and 06 of the lower main connection pipes 25 may be controlled by controlling pipeline valve bodies, so as to control and adjust the dosage of the compressed air and lubricant mixture sprayed into the closed cavities A, B and C and then sprayed to the working surface of the upper die through the nozzles 1, and also to control the dosage of the compressed air and lubricant mixture sprayed into the closed cavities E, F and G and then sprayed to the working surface of the lower die through the nozzles 1, thereby automatically controlling the dosage of the lubricant on the working surface of the die, achieving the forging lubrication objective and reducing the forging defects.

In the present disclosure, a PLC (Programmable Logic Controller) control unit controls the rotating speed and rotating time of the servo motor, and controls the pipeline valve bodies to control the flow rates, the flow velocities and the pressures of the compressed air and the lubricant, thereby controlling and adjusting the dosages of the compressed air and the lubricant to automatically control the dosage of the lubricant sprayed onto the working surface of the die. The pipeline valve bodies of the compressed air and lubricant valve body control pipelines and the servo motor are all connected with the PLC control unit in a signal manner, and the PLC control unit controls the flow rates, the flow velocities and the pressures of the compressed air and the lubricant by controlling the pipeline valve bodies, and controls the rotating speed and rotating time by controlling the servo motor, so as to control the amount of the lubricant sprayed to the surface of the die.

Embodiment 2

In Embodiment 2, in order to reduce the weight of a cantilever of the spray tray connection body 24, the components such as the servo motor 10, the motor shaft flange 11, the coupling 12, the belt rotating motor shaft bearings 13, the belt rotating motor shaft 14 and the end flange 18 may also be designed and mounted at the position P from the position Q in FIGS. 1, 2 and 3 without interference with a main line. Specifically, in Embodiment 2, the rotating driving mechanism is arranged on the spray tray connection body 24; the output shaft of the rotating driving mechanism passes through the spray tray connection body 24 from top to bottom; the motor shaft flange 11 is fixed on the upper end face of the spray tray connection body 24 on the left of the spray tray main body 23; the upper and lower belt rotating motor shaft bearings 13 are fixed on the hollow cavity wall of the spray tray connection body 24; and the end flange 18 is fixed on the hollow cavity wall of the lower end face of the spray tray connection body 24, so that the structure is more optimal and compact.

Based on the above, the present disclosure provides the rotating spray device for a lubricant. The rotating driving mechanism rotates to drive the rotating spindle through the transmission mechanism to rotate, and the rotating spindle drives the upper and lower rotating spray trays to rotate. The compressed air and the lubricant are respectively fed into each pitch circle closed cavity formed between each of the rotating spray trays and the spray tray main body, and then are sprayed out through the nozzles on the rotating spray trays for uniform spray coating. The device can spray the same and uniform dosage of the lubricant to the working surfaces of the maximum pitch circles of the upper and lower dies, play a role of uniform forging lubrication and reduce the forging defects, and can realize automatic spraying of the lubricant to the working surfaces of the maximum pitch circles of the upper and lower dies, increase the automation degree of equipment, meet efficient production requirements, work safely and reliably and improve the working efficiency.

The embodiments of the application are described in detail above, particular examples are used herein to explain the principle and embodiments of the application, and the above description of the embodiments is only used to help understanding the methods and core concept of the application; and meanwhile, for those having ordinary skill in the art, according to the idea of the application, there will be changes in the specific implementation mode and application scope, in conclusion, the contents of the specification shall not be construed as a limitation of the application.

The invention claimed is:

1. A rotating spray device for a lubricant, comprising a spray tray main body having a top surface and a bottom surface, a spray tray connection body, rotating spray trays, nozzles, upper main connection pipes, upper air pipe joints, upper lubricant pipe joints, lower main connection pipes, lower air pipe joints, lower lubricant pipe joints, a rotating spindle, a transmission mechanism and a rotating driving mechanism, wherein the spray tray connection body passes through the middle part of the spray tray main body and extends out of the spray tray main body; the spray tray main body is divided into an upper portion and a lower portion, and the sprat tray connection body is of a hollow cavity structure; each of the top surface and the bottom surface of the spray tray main body is provided with one rotating spray tray; the nozzles are mounted on the rotating spray trays; at least one circular-ring-shaped pitch circle closed cavity are formed between the rotating spray trays and the spray tray main body; each pitch circle closed cavity of the at least one circular-ring-shaped pitch circle closed cavity communicates with the outside through the nozzles; each pitch circle closed cavity formed between the rotating spray tray on the top surface and the spray tray main body is connected with one upper air pipe joint and one upper lubricant pipe joint through one upper main connection pipe; compressed air is input through the upper air pipe joints, and a lubricant is input through the upper lubricant pipe joints; each pitch circle closed cavity formed between the rotating spray tray on the bottom surface and the spray tray main body is connected with one lower air pipe joint and one lower lubricant pipe joint through one lower main connection pipe; the compressed air is input through the lower air pipe joints, and the lubricant is input through the lower lubricant pipe joints;

the rotating spindle passes through the rotating spray tray on the top surface, the upper portion of the spray tray main body, the spray tray connection body, the lower portion of the spray tray main body and the rotating spray tray on the bottom surface from the center portions of the rotating spray trays from top to bottom; the rotating spray tray on the top surface and the rotating spray tray on the bottom surface are fixed on the rotating spindle, and may rotate with the rotation of the rotating spindle; the rotating driving mechanism is also arranged on the spray tray main body; an output shaft of the rotating driving mechanism passes through the upper portion of the spray tray main body, the spray tray connection body and the lower portion of the spray tray main body, or the rotating driving mechanism is arranged on the spray tray connection body, and the output shaft of the rotating driving mechanism passes through the spray tray connection body from top to bottom; the transmission mechanism is located in the hollow cavity structure of the spray tray connection body; the transmission mechanism is connected with the rotating driving mechanism and the rotating spindle; and the rotating driving mechanism rotates to drive the rotating spindle through the transmission mechanism to rotate; the rotating spindle drives the rotating spray tray located on the top surface and the rotating spray tray located on the bottom surface to rotate; the compressed air and the lubricant are respectively fed into each pitch circle closed cavity formed between each of the rotating spray trays and the spray tray main body, and then are mixed and sprayed out through the nozzles on the rotating spray trays for spray coating.

2. The rotating spray device for a lubricant according to claim 1, wherein the rotating driving mechanism comprises a servo motor, a motor shaft flange, a coupling, belt rotating motor shaft bearings, a belt rotating motor shaft and an end flange; the servo motor is arranged on the motor shaft flange; the motor shaft flange is fixed on the upper end face of the spray tray main body or the upper end face of the spray tray connection body, and is used to fix the servo motor; the belt rotating motor shaft bearings are used to fix the belt rotating motor shaft; two belt rotating motor shaft bearings are respectively located at the upper and lower ends of the belt rotating motor shaft; the upper and lower belt rotating motor shaft bearings are fixed in the spray tray main body or the spray tray connection body; the end flange is arranged at the lower end of the belt rotating motor shaft, located on the lower end face of the spray tray main body or the lower end face of the spray tray connection body, and used to fix the belt rotating motor shaft bearings and the belt rotating motor shaft; an output shaft of the servo motor passes through the motor shaft flange and is connected to the coupling; the coupling is connected with the output shaft of the servo motor and the belt rotating motor shaft; the portion, located in the spray tray connection body, of the belt rotating motor shaft is provided with a first connection key; and the first connection key is connected with the transmission mechanism.

3. The rotating spray device for a lubricant according to claim 2, wherein the transmission mechanism comprises a small belt wheel, a toothed belt and a large belt wheel; a second connection key is arranged on the rotating spindle; the small belt wheel is fixed on the belt rotating motor shaft through the first connection key; the large belt wheel is fixed on the rotating spindle through the second connection key; the toothed belt is connected with the small belt wheel and the large belt wheel; the belt rotating motor shaft rotates to drive the small belt wheel to rotate, and the small belt wheel drives the large belt wheel through the toothed belt to rotate, and the large belt wheel drives the rotating spindle to rotate.

4. The rotating spray device for a lubricant according to claim 1, wherein the output end of each upper main connection pipe has a horizontal 270-degree circular arc bend; one output port is arranged on the horizontal 270-degree circular arc bend every 90 degrees, and communicates with the upper circular-ring-shaped pitch circle closed cavity corresponding to the upper main connection pipe; the output end of each lower main connection pipe has a horizontal 270-degree circular arc bend; and one output port is arranged on the horizontal 270-degree circular arc bend every 90 degrees, and communicates with the lower circular-ring-shaped pitch circle closed cavity corresponding to the lower main connection pipe.

5. The rotating spray device for a lubricant according to claim 1, wherein an upper bearing of spindle and a lower bearing of spindle are respectively arranged at the upper portion and the lower portion of the rotating spindle; the upper bearing of spindle is located in the rotating spray tray on the top surface, and is in contact with the upper surface of the spray tray main body; the lower bearing of spindle is located in the rotating spray tray on the bottom surface, and is in contact with the lower surface of the spray tray main body; an upper bearing of rotating spray tray is arranged between the rotating spray tray on the top surface and the spray tray main body; and a lower bearing of rotating spray tray is arranged between the rotating spray tray on the bottom surface and the spray tray main body.

6. The rotating spray device for a lubricant according to claim 1, wherein four nozzles are arranged on the rotating spray tray on each pitch circle closed cavity, and are spaced by 90 degrees; the positions of the nozzles of the various pitch circle closed cavities at the upper end of the spray tray main body correspond to one another, and the nozzles in all the directions are located on one straight line; the positions of the nozzles of the various pitch circle closed cavities at the lower end of the spray tray main body correspond to one another, and the nozzles in all the directions are located on one straight line.

7. The rotating spray device for a lubricant according to claim 1, wherein sealing rings are arranged between the pitch circle closed cavities at the upper end of the spray tray main body and between the rotating spray tray on the top surface and the spray tray main body; and sealing rings are arranged between the pitch circle closed cavities at the lower end of the spray tray main body and between the rotating spray tray on the bottom surface and the spray tray main body.

8. The rotating spray device for a lubricant according to claim 1, wherein the spray tray connection body and the spray tray main body are of an integrated structure, and the upper main connection pipes and the lower main connection pipes are passages arranged in the spray tray connection body and the spray tray main body.

9. The rotating spray device for a lubricant according to claim 8, wherein the input ends of the upper main connection pipes and the lower main connection pipes are all provided with main pipe joints, and the main pipe joints are connected with the upper air pipe joints and the upper lubricant pipe joints or the main pipe joints are connected with the lower air pipe joints and the lower lubricant pipe joints; the output ports of the upper main connection pipes and the lower main connection pipes are all provided with internal nozzles; and the internal nozzles are located in the pitch circle closed cavities.

10. The rotating spray device for a lubricant according to claim 1, wherein the upper air pipe joints and the lower air pipe joints are connected to a compressed air valve body control pipeline, and the upper lubricant pipe joints and the lower lubricant pipe joints are connected to a lubricant valve body control pipeline; the device further has a control unit; the control unit is connected with pipeline valve bodies of the compressed air valve body control pipeline and the lubricant valve body control pipeline and the servo motor in the rotating driving mechanism in a signal manner; the control unit controls the flow rates, the flow velocities and the pressures of the compressed air and the lubricant by controlling the pipeline valve bodies, and controls the rotating speed and rotating time by controlling the servo motor, thereby controlling the amount of the lubricant sprayed to the surface of a die.

* * * * *